US010918193B2

(12) United States Patent
Romang

(10) Patent No.: US 10,918,193 B2
(45) Date of Patent: Feb. 16, 2021

(54) TOOL HOLDER SYSTEM

(71) Applicant: Timothy M. Romang, Hampton, IL (US)

(72) Inventor: Timothy M. Romang, Hampton, IL (US)

( * ) Notice: Subject to any disclaimer, the term of this patent is extended or adjusted under 35 U.S.C. 154(b) by 37 days.

(21) Appl. No.: 16/458,091

(22) Filed: Jun. 30, 2019

(65) Prior Publication Data

US 2020/0008561 A1 Jan. 9, 2020

Related U.S. Application Data

(60) Provisional application No. 62/693,926, filed on Jul. 4, 2018.

(51) Int. Cl.

| | |
|---|---|
| ***A45F 3/14*** | (2006.01) |
| ***B25H 3/00*** | (2006.01) |
| ***A62C 8/00*** | (2006.01) |

(52) U.S. Cl.

CPC ..... *A45F 3/14* (2013.01); *A62C 8/00* (2013.01); *B25H 3/00* (2013.01); *A45F 2003/146* (2013.01)

(58) Field of Classification Search

CPC ..... A45F 3/04; A45F 3/14; A45F 200/146; A45F 200/148; A45F 200/001; A45F 200/003; A45F 2005/025; A45F 2005/026; A45F 2005/027; A45F 2005/028; A62C 8/00; B25H 3/00; B25H 3/006

USPC ..... 224/234, 195, 647

See application file for complete search history.

(56) References Cited

U.S. PATENT DOCUMENTS

| | | | | |
|---|---|---|---|---|
| 3,130,883 A * | 4/1964 | MacKool | A45F 5/14 | 224/232 |
| 4,773,577 A * | 9/1988 | Mikula | A45F 5/14 | 224/234 |
| 6,237,822 B1 * | 5/2001 | Vidal | A45F 5/14 | 224/234 |
| 6,719,178 B1 * | 4/2004 | Taylor | A45F 3/02 | 224/148.7 |
| 8,910,410 B2 * | 12/2014 | Peters | F41C 33/006 | 42/90 |
| 9,629,398 B2 * | 4/2017 | Goryl | A41D 13/0012 | |

* cited by examiner

*Primary Examiner* — Corey N Skurdal

(74) *Attorney, Agent, or Firm* — Law Offices of Robert M. Patino

(57) ABSTRACT

A tool holder system for carrying a tool on a person is provided where the tool holder system includes a harness comprising a plurality of body straps, a guide rail strap provided with a guide and an at least one guide locking strap secured to a front end of the plurality of body straps of the harness, and a sheath for supporting the tool wherein the sheath corresponds to said guide with a post secured to said sheath for maneuvering said sheath linearly in relation to the guide on the guide rail strap.

17 Claims, 3 Drawing Sheets

TOOL HOLDER SYSTEM

BACKGROUND

In a structure fire situation, firefighters commonly enter a burning structure in groups of two or three. There are various tasks that need to be accomplished that require the use of two hands depending on the situation as each fire is unique to itself. For example, many times the first-in-a-structure firefighter will deploy the hose line, which requires the use of both hands. In another situation, firefighters might climb a ladder to the roof or a higher window, which also requires the use of both hands. In another situation, a fire fighter's assignment might be to search for people or animals in a structure. In each of these situations the firefighter needs to have both hands as free as possible to drag the hose, climb a ladder or search for victims. To perform these exercises that require both hands, firefighters are required to leave behind their axe, a potentially lifesaving tool, because there is not an effective way to carry their axe.

Currently, firefighters might put a full-size tool or axe tucked in their waist strap or on a belted sheath. Other options include a miniature tool or axe on a hammer hoop attached to their belt. However, firefighters most commonly enter a structure without a tool or axe due to inconvenience or safety concerns.

There are drawbacks in the presently employed carrying techniques. Carrying a full-size axe causes difficulty when crawling on the ground as a full-size axe is 3 feet long and drags on the ground, limiting the firefighter's movement. Also, an axe tucked in one's waist strap is insecure and may fall out or become problematic in tight situations. A miniature tool or axe could be helpful for small issues; however, if the firefighter finds himself in a serious life-threatening situation, a large capable tool or axe is needed to bring down doors or make an egress through floors, walls and roofs.

These shortcomings are addressed by the present invention referred to as a tool holder system. The invention pertains to aiding a firefighter to effectively carry needed tools or axes on a fireground by the firefighter. However, it can be appreciated that this tool holder system may be used by other operators that use a harness such as a rock climber, mountain climber, scuba diver or other operator.

SUMMARY OF THE INVENTION

The present tool holder system addresses these abovementioned problems by allowing the firefighter or operator to be equipped with a tool attached to a harness. The harness can be used to support a Self-Contained Breathing Apparatus (SCBA), that among other pieces of equipment, may include an air tank. However, the present tool holder system is compatible with the SCBA as a guide rail strap is easily attached in the front of a person and may extend over the operator's right shoulder or left shoulder and extends to terminate at a termination point on a rear side of the harness. The rear side is where an air tank might be optionally found on the harness. The tool holder system allows the operator to carry a tool on his back and leaves the operator's hands free for necessary tasks. The operator is then able to deploy a tool when needed. The operator wearing the tool holder system on his SCBA also makes the tool accessible to a second operator that might be positioned behind him.

In a first embodiment of the invention, a tool holder system for carrying a tool on a person is provided where the tool holder system includes a harness comprising a plurality of body straps, a guide rail strap provided with a guide and an at least one guide locking strap secured to a front end of the plurality of body straps of the harness, and a sheath for supporting the tool wherein the sheath corresponds to said guide with a post secured to said sheath for maneuvering said sheath linearly in relation to the guide on the guide rail strap.

In an alternative embodiment of the invention, a method of carrying a tool using a tool holder system on a person is provided wherein the tool holder system comprises a sheath and a guide rail strap secured to a harness. The method then comprises of steps such as inserting a head of a tool into a sheath and where the sheath is provided with a post located on a back side of the sheath, then inserting a post head of the post into a post receiving slot of a guide located on the guide rail strap, and then sliding the sheath along a length of the guide rail strap to terminate at a termination point on said guide and the termination point is located proximate to a rear side of the harness.

In yet another alternative embodiment of the invention, a tool holder system for carrying a tool on a person is provided where the tool holder system comprises a harness. The harness is comprised of a right shoulder strap, a left shoulder strap and a waist strap. Furthermore, there is a guide rail strap that is provided with a guide and an at least one guide locking strap secured to a front end of the right shoulder strap or secured to a front end of the left shoulder strap. Moreover, a sheath is also provided for supporting the tool wherein the sheath corresponds to the guide with a post secured to the sheath for maneuvering the sheath linearly in relation to the guide on the guide rail strap. Optionally, a waist strap clip is provided and located on the waist strap that corresponds to an extended end of the tool.

DETAILED DESCRIPTION

Figure 1:
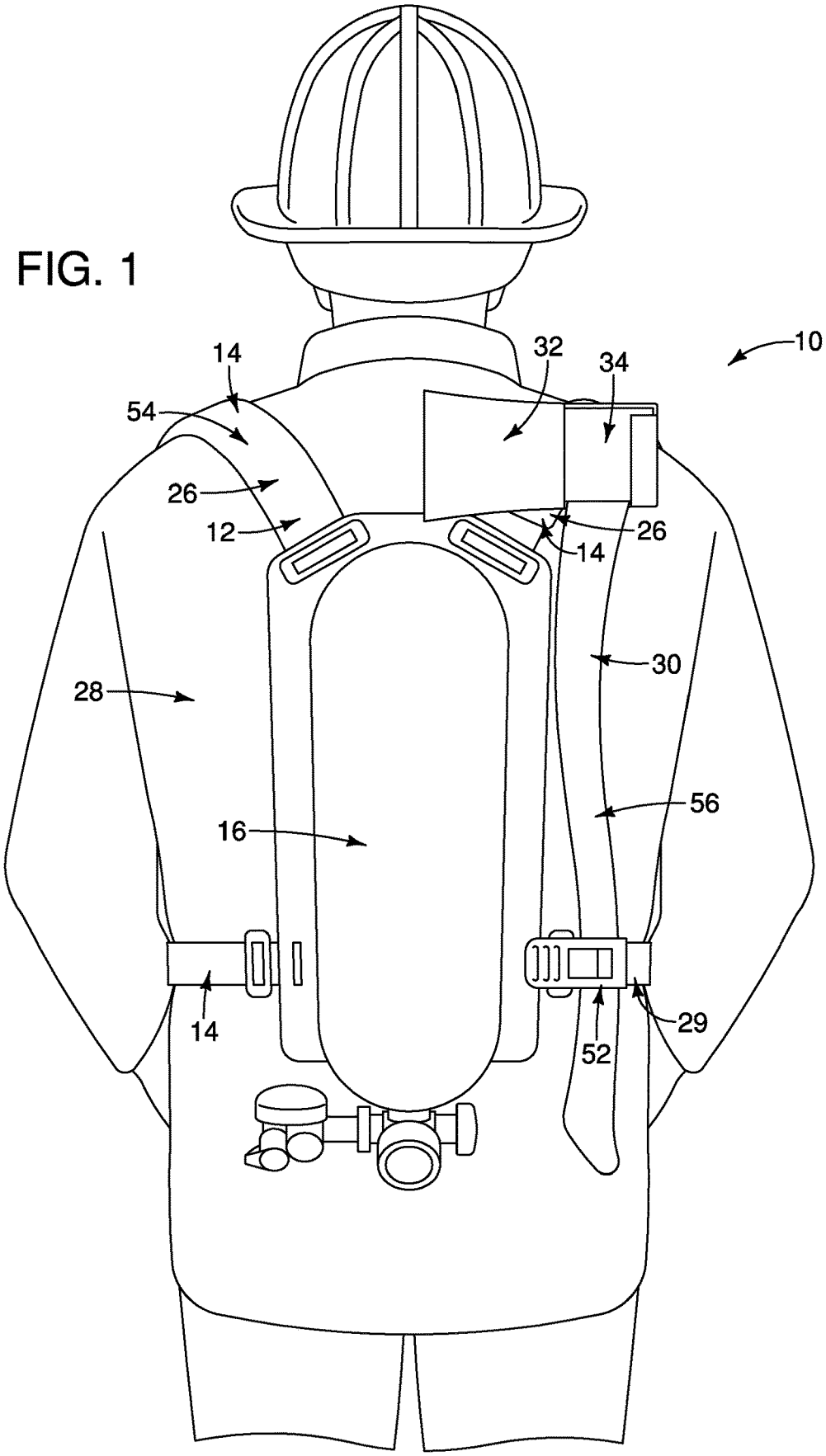
FIG. 1 is a view of a tool holder system in operation on the back of an operator.

The tool holder system 10 as shown in FIG. 1 may be partially comprised of a harness 12 that has a plurality of body straps 14 that secure the harness and is optionally provided with an air tank 16 in one embodiment. It is this general setup that makes the foundation of a Self-Contained Breathing Apparatus or SCBA that can be used for fire fighters, divers, mountain climbers and other professionals or adventurers.

Figure 2:
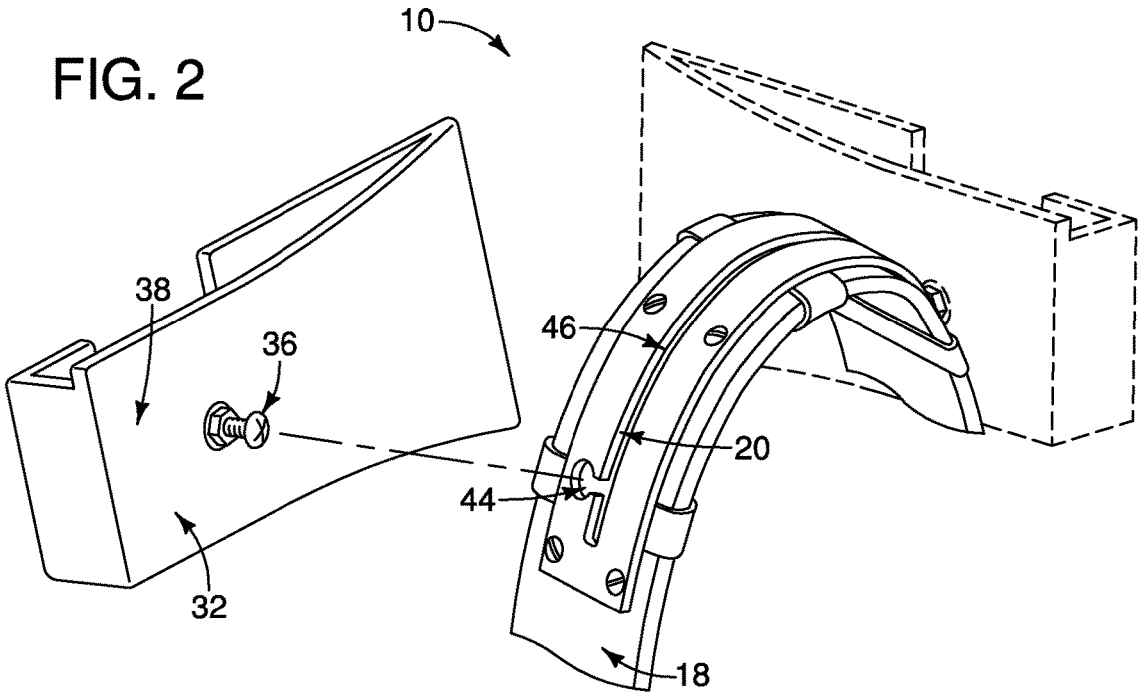
FIG. 2 is a view of a sheath and a guide rail strap without a series of guide locking straps that comprise the tool holder system.
Figure 3:
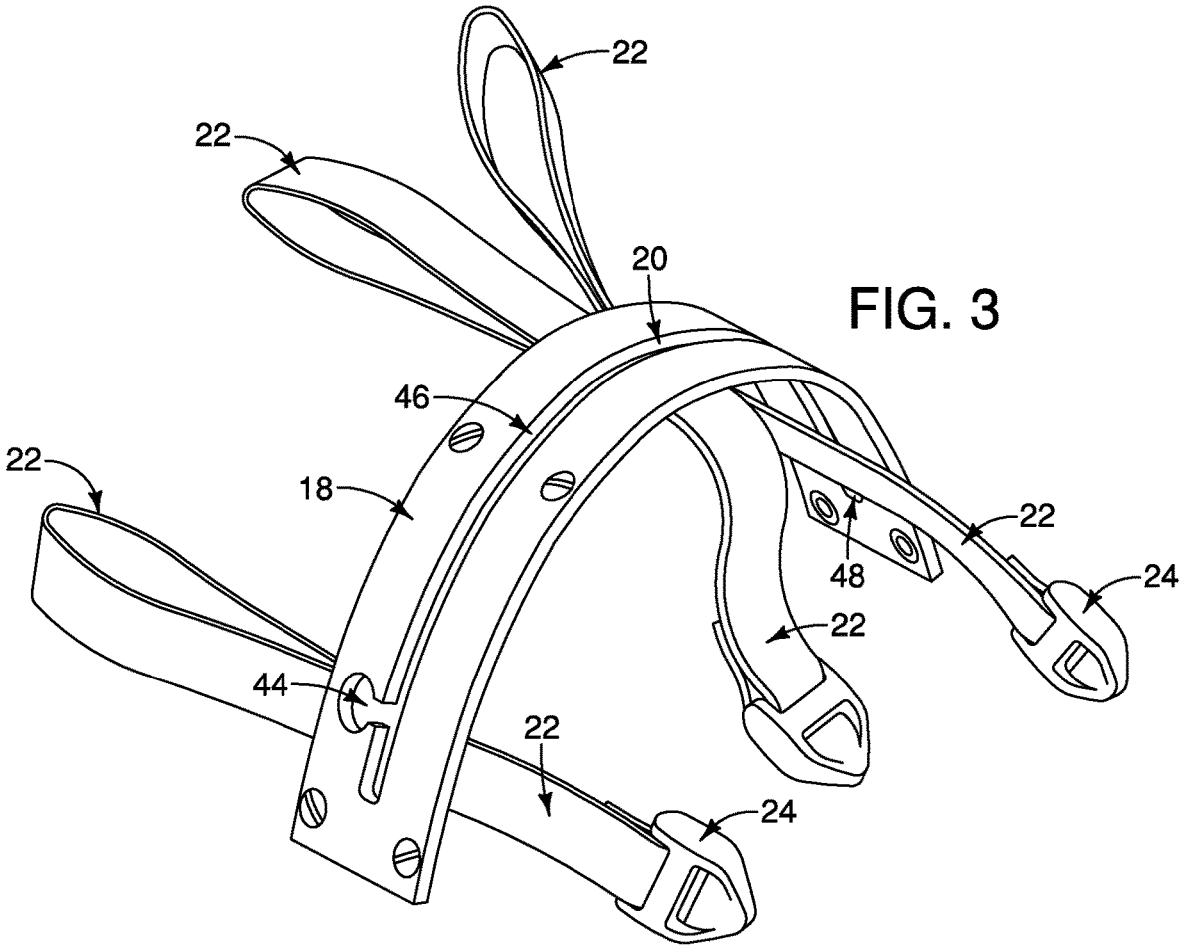
FIG. 3 is a view of the guide rail strap with a series of guide locking straps to secure the tool holder system to the individual.

Now referring to FIGS. 2 and 3, the main part of the tool holder system 10 features a guide rail strap 18 that is secured to the harness 12 and the guide rail strap 18 is provided with a guide 20 and an at least one guide locking strap 22 that secures the guide rail strap 18 to a front end (not shown) of the plurality of body straps 14 of the harness 12. The guide 20 may be raised as a member that may be secured to the guide rail strap 18. It may be secured by a means of a plurality of screws, adhered with an adhesive or sewn or stapled to the fabric just to mention a few examples. The guide rail strap 18 is preferably made of a durable material to withstand the intended environment. The intended environment could be in a fire burning structure, on a mountain, underwater or other environmental condition. In most instances, a leather guide rail strap 18 would be ideal, but rubber, plastic, metal, infused fabric, or polyester could make good guide rail strap 18 material. The at least one guide locking strap 22 is preferably lockable in multiple lengths to ensure the guide rail strap 18 is secure to the front end of the plurality of body straps 14. The multiple lengths could be achieved using Velcro, buttons, buckle mechanism or other means well known in the art. In a preferred embodiment, a claw buckle 24 is used to ensure the grip is snug and tight. Furthermore, in a preferred embodiment, two guide locking straps 22 are used and in another preferred embodiment, three guide locking straps 22 are used to ensure that there are multiple anchor points along the front end and a back end 26 of the plurality of body straps 14 to ensure stability. At least one guide locking strap 22 is secured to the back end 26 of the plurality of body straps 14 of the harness 12.

The guide rail strap 18 is attached to the harness 12 and is removable or stationary depending on the needs of an operator 28. In a preferred embodiment, the plurality of body straps 14 comprise of a right shoulder strap, a left shoulder strap and a waist strap 29. The operator 28 then can decide when to attach a tool 30 (or axe) to the harness 12 via the tool holder system 10. This allows the operator 28 or firefighter to get dressed on the way to a location. The operator 20 puts on his harness 12, then attaches the tool 30 when the operator 28 gets out of a vehicle or fire engine. The operator 28 then can wear the tool 30 as long as he desires, then remove the tool 30 when the tool 30 is no longer needed on his back.

Figure 4:
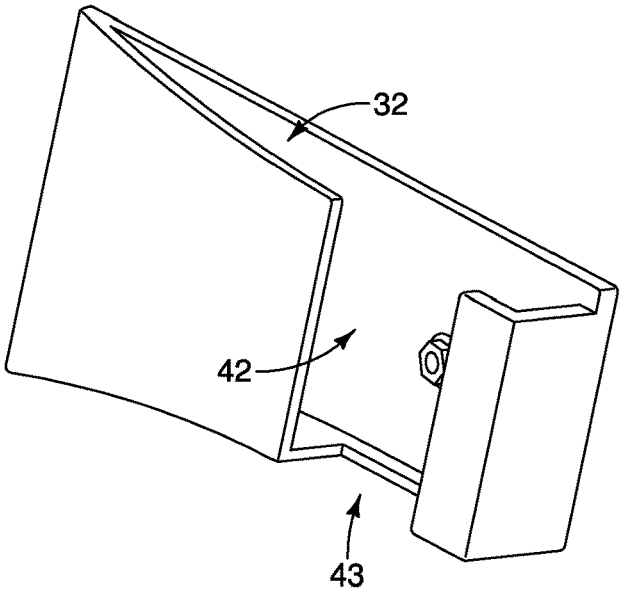
FIG. 4 is front perspective view of the sheath.
Figure 5:
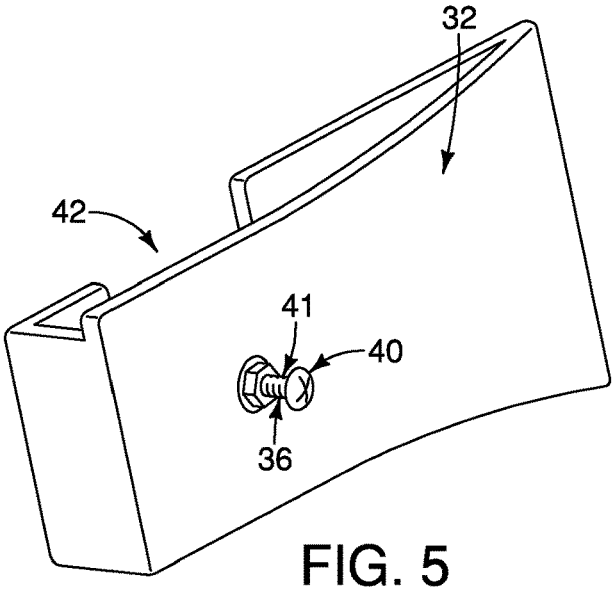
FIG. 5 is rear perspective view of the sheath.

Now referring to FIGS. 2, 4 and 5, a sheath 32 for supporting the tool 30 is also provided and preferably corresponds to a head 34 (see FIG. 1) of the tool 30. When the tool 30 is an axe, the head 34 would constitute the blade and face portion of the axe. The sheath 32 can be made of a durable material, but the material is preferably pliable to better conform to the head 34 and may comprise of a leather, plastic, rubber or fabric material (such as nylon). The sheath 32 corresponds to the guide 20 with a post 36 secured to the sheath 32 for maneuvering said sheath 32 linearly in relation to the guide 20 on the guide rail strap 18. In a preferred embodiment, the post 36 is attached to a back side 38 of the sheath 32. Referring now to FIG. 5, in the preferred embodiment, the post 36 is provided with post head 40 and a post stem 41 and wherein the post head diameter is greater than a post stem diameter. Referring now to FIGS. 4 and 5, the sheath 32 is provided with a sheath front side gap 42 to allow an extended end 56 of the tool 30 to feed through the sheath 32 and rest on a sheath bottom lip 43. The sheath bottom lip 43 should extend sufficiently to hold the head 34 but reside back enough to allow the extended end 56 to reside in a downward direct that is parallel to the air tank 16. In this embodiment, the head 34 of the tool 30 can easily be inserted or removed from the sheath 32 by sliding the head 34 through a top area of the sheath 32 and slipping the extended end 56 of the tool 30 through the sheath front side gap 42 until the head rests on the sheath bottom lip 43.

In one embodiment, the sheath 32 has a length of about 8 to 10 inches, a height of about 4 to 6 inches tall and a width from about 1 to 2 inches. The post 36 in one embodiment has a height of about ½ an inch to 1 inch and the post head 40 of the post 36 is about ¼ of an inch. The guide 20 preferably has a length of about 12 to 18 inches. The sheath 32 is optionally provided with a head strap (not shown) that extends from the back side 38 of the sheath 32 to the opposite side of the sheath 32 (also referred to as the sheath front side) to secure the head 34 into the sheath 32. The head strap, in a preferred embodiment, is sewn or adhered into one side (either the back side 38 or sheath front side) and is buttoned, Velcroed or buckled into the opposite side. This mechanism fastens the head 34 into the sheath 32 and prevents the head 34 from slipping out of the sheath 32.

Referring now to FIGS. 2 and 3, to attach the sheath 32 to the guide rail strap 18, the guide 20 on the guide rail strap 18 is provided with a post receiving slot 44 with a slot diameter greater than the post head diameter of the post 36 and a post channel 46 with a channel width less than the post head diameter. This configuration allows the sheath 32 to be slideably connected to the guide rail strap 18. When the tool holder system 10 is in operation on the operator 28, the post receiving slot 44 resides on the guide rail strap 18 located proximate to the front end (not shown) of the plurality of body straps 14 of said harness 12. The post channel 46 begins as an extension of the post receiving slot 44 and extends along a length of the guide rail strap 18 referred to as the post channel 46 to terminate at a termination point 48 on said guide 20. The termination point 48 is located proximate to a back end 26 of the plurality of body straps 14 of the harness 12. As such, the head 34 of the tool 30 in the sheath 32 is moveable through the length of the guide 20 so that the tool 30 travels over the shoulder of the operator 28 to rest alongside an air tank 16 as shown in FIG. 1.

Figure 6:
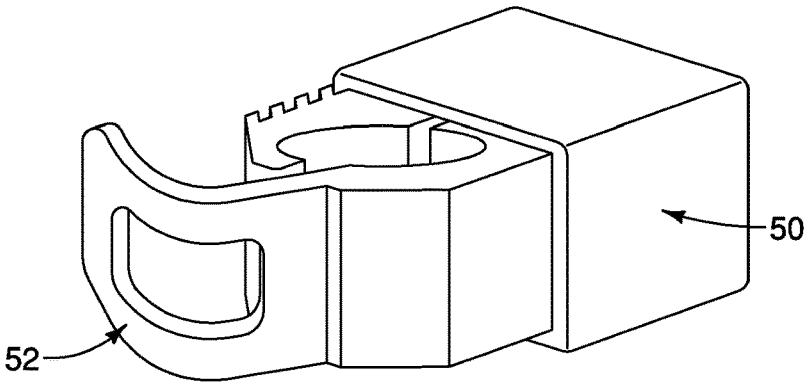
FIG. 6 is a waist strap clip that may optionally be provided to the tool holder system to secure a tool to the waist strap of a harness.

Now referring to FIGS. 1 and 6, in a preferred embodiment, the tool holder system 10 also comprises of the waist strap clip 50 that corresponds to the tool 30. The waist strap clip 50 is located on the waist strap 29 that secures the tool 30 to the waist strap 29 of the harness 12. The waist strap clip 50 may be fed onto the waist strap 29 through a belt slit or clipped onto the waist strap 29. The waist strap clip 50 holds the tool 30 in place enabling the operator 28 to crawl or move quickly without the tool 30 from becoming dislodged. The waist strap clip 50 fastens the tool 30 in a secure position with a locking mechanism 52. The locking mechanism 52 is preferably a tightening strap that has a loop that fastens onto some corresponding teeth as shown in FIG. 6, but the locking mechanism could also be a collapsing clamp, Velcro strap, belt with buckle or other known means in the art to fasten a protruding object to a belt or waist strap 29.

Use of the tool holder system 10 for carrying a tool 30 on a person generally involves the following steps. An operator 28 inserts the head 34 of the tool 30 into the sheath 32. The sheath 32 is provided with a post 36 located on a back side 38 of the sheath 32. The operator 28 inserts the post head 40 of the post 36 into the post receiving slot 44 of the guide 20 located on the guide rail strap 18. The operator 28 then slides the sheath 32 along a length of the guide rail strap 18 to terminate at a termination point 48 on the guide 20. The termination point 48 is located proximate to a rear side 54 of the harness 12. Optionally, the operator 28 or other person can fasten the tool 30 to the waist strap clip 50 located on the waist strap 29 of the harness 12. The fastening is achieved by tightening the tightening strap around an extended end 56 of the tool 30. Ideally the operator 28 should be able to release the locking mechanism 52 with one hand. Optionally, a person from behind the operator 28 should be able to release the locking mechanism 52 and remove the tool 30 from the sheath 32.

While a particular embodiment of the tool holder system has been described herein, it will be appreciated by those skilled in the art that changes and modifications may be made thereto without departing from the invention in its broader aspects and as set forth herein.

I claim:

1. A tool holder system for carrying a tool on a person, said tool holder system comprising:

a harness comprising a plurality of body straps;

a guide rail strap provided with a guide and an at least one guide locking strap secured to a front end of said plurality of body straps of said harness; and a sheath for supporting the tool wherein said sheath corresponds to said guide with a post secured to said sheath for maneuvering said sheath linearly in relation to said guide on said guide rail strap.

2. The tool holder system of claim 1, wherein said guide comprises of a post receiving slot with a slot diameter greater than a post head diameter of said post and a post channel with a channel width less than said post head diameter.

3. The tool holder system of claim 2, wherein said post receiving slot resides on said guide rail strap located proximate to said front end of said plurality of body straps of said harness.

4. The tool holder system of claim 3, wherein said post channel begins as an extension of said post receiving slot and extends along a length of said guide rail strap to terminate at a termination point on said guide and said termination point is located proximate to a back end of said plurality of body straps of said harness.

5. The tool holder system of claim 4, wherein said post is attached on a back side of said sheath.

6. The tool holder system of claim 5, wherein said post is provided with post head and a post stem and wherein said post head diameter is greater than a post stem diameter.

7. The tool holder system of claim 4, wherein said at least one guide locking strap is secured to said back end of said plurality of body straps of said harness.

8. The tool holder system of claim 1, wherein said sheath is provided with a head strap that extends from a back side of said sheath to a sheath front side to secure a head of the tool into said sheath.

9. The tool holder system of claim 1, wherein said plurality of body straps comprise of a right shoulder strap, a left shoulder strap and a waist strap.

10. The tool holder system of claim 9, wherein said waist strap is provided with a waist strap clip that corresponds to the tool.

11. The tool holder system of claim 10, wherein said waist strap clip fastens the tool in a secure position with a locking mechanism.

12. The tool holder system of claim 11, wherein said locking mechanism is a tightening strap.

13. A method of carrying a tool using a tool holder system on a person, wherein said tool holder system comprises a sheath and a guide rail strap secured to a harness, said method comprises:

inserting a head of the tool into the sheath and the sheath is provided with a post located on a back side of the sheath;

inserting a post head of said post into a post receiving slot of a guide located on the guide rail strap; and sliding the sheath along a length of the guide rail strap to terminate at a termination point on said guide and said termination point is located proximate to a rear side of the harness.

14. The method of carrying a tool of claim 13, further comprising the step of:

fastening the tool to a waist strap clip located on a waist strap of the harness.

15. The method of carrying a tool of claim 14, where in the fastening is achieved by tightening a tightening strap around an extended end of the tool.

16. The method of carrying a tool of claim 13, further comprising the step of:

fastening a head strap that extends from said back side of the sheath to the opposite side of the sheath front side to secure said head of the tool into the sheath.

17. A tool holder system for carrying a tool on a person, said tool holder system comprising:

a harness comprising a right shoulder strap, a left shoulder strap and a waist strap;

a guide rail strap provided with a guide and an at least one guide locking strap secured to a front end of said right shoulder strap or secured to a front end of said left shoulder strap;

a sheath for supporting the tool wherein said sheath corresponds to said guide with a post secured to said sheath for maneuvering said sheath linearly in relation to said guide on said guide rail strap;

a head strap that extends from a back side of said sheath to the sheath front side; and a waist strap clip located on said waist strap that corresponds to an extended end of the tool.

* * * * *